United States Patent [19]

Crook

[11] Patent Number: 4,555,440

[45] Date of Patent: Nov. 26, 1985

[54] MULTILAYERED PRESS FELT

[75] Inventor: Robert L. Crook, Saratoga Springs, N.Y.

[73] Assignee: Albany International Corp., Menands, N.Y.

[21] Appl. No.: 688,303

[22] Filed: Jan. 2, 1985

[51] Int. Cl.[4] ..... B32B 7/08

[52] U.S. Cl. ..... 428/223; 162/358; 162/DIG. 1; 428/224; 428/280; 428/282

[58] Field of Search ..... 162/DIG. 1, 358; 428/224, 280, 282, 257, 223, 105, 107, 108, 109, 110, 112, 113, 114, 221; 139/383 A

[56] References Cited

U.S. PATENT DOCUMENTS

| | | | |
|---|---|---|---|
| 4,224,372 | 9/1980 | Romanski | 428/257 |
| 4,257,835 | 3/1981 | Bompard | 428/223 |
| 4,416,929 | 11/1983 | Krueger | 428/110 |

*Primary Examiner*—James J. Bell

*Attorney, Agent, or Firm*—Kane, Dalsimer, Kane, Sullivan & Kurucz

[57] ABSTRACT

A press felt is disclosed having a plurality of horizontal layers of parallel unwoven yarns, bound vertically together by a thread. The disclosed structure exhibits high compaction resistance and water retention characteristics. One of the layers may be made of resilient yarns to act as a shock absorber.

19 Claims, 4 Drawing Figures

MULTILAYERED PRESS FELT

BACKGROUND OF THE INVENTION

1. Field of Invention

This invention pertains to a press felt fabric and more particularly a fabric comprising a plurality of superimposed non-woven orthogonal layers.

2. Description of the Prior Art

A major portion of the art of paper making consists of sequential stages in which water is removed from a paper web. These various stages are differentiated by the different methods used to remove the water from the web. One such method is to provide a press felt for contacting the web while the felt and the web are passed through a high pressure region formed by a press nip. During this process water impressed out of the web is forced into or absorbed by the press felt. It has been long recognized that an ideal press felt must be permeable to water, must resist compaction, and must maintain its dimensional stability. Numerous woven and non-woven fabrics have been suggested as press felts however improved results is continuously sought.

OBJECTIVES AND SUMMARY OF THE INVENTION

An objective of the present invention is to provide a press felt having the ability to retain relatively large quantities of water.

Another objective is to provide a felt which resists compaction. A further objective is to provide a press felt with a long useful life.

Other objectives and advantageous of the invention shall become apparent in the following description of the invention.

According to this invention, a press felt comprises a plurality of non-woven layers of yarns, each layer being oriented orthogonally with respect to the adjacent layer(s) to form an open structure. The layers are bound together by a relatively thin thread which is passed perpendicularly through the layers and extends in the cross-machine direction. Preferably one of the layers is made of an elastomeric yarn to add resiliency to the structure thereby increasing its sensitivity to compaction.

DETAILED DESCRIPTION OF THE INVENTION

Figure 1:
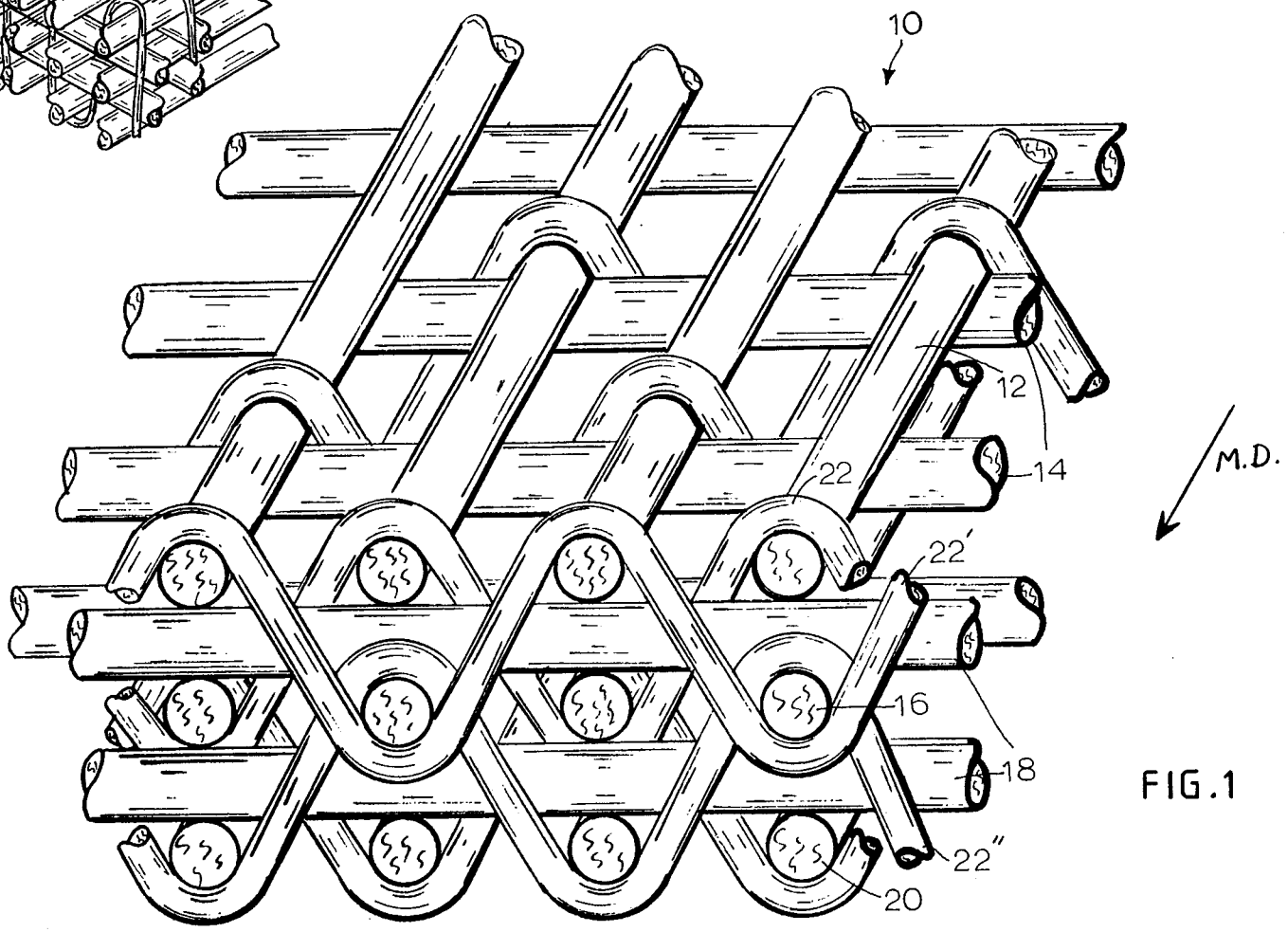
FIG. 1 shows details of a press felt constructed in accordance with the present invention.
Figure 2:
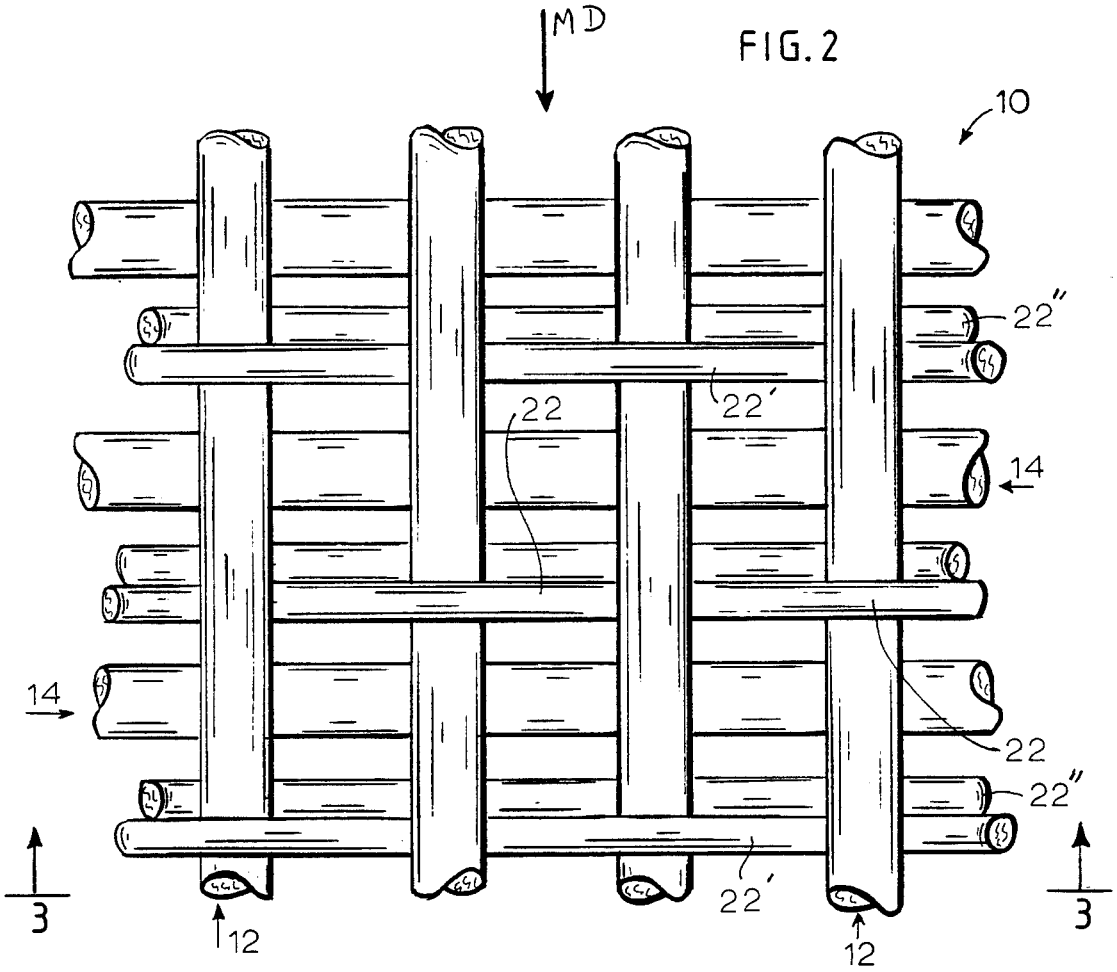
FIG. 2 is a first cross-sectional view of FIG. 1.
Figure 3:
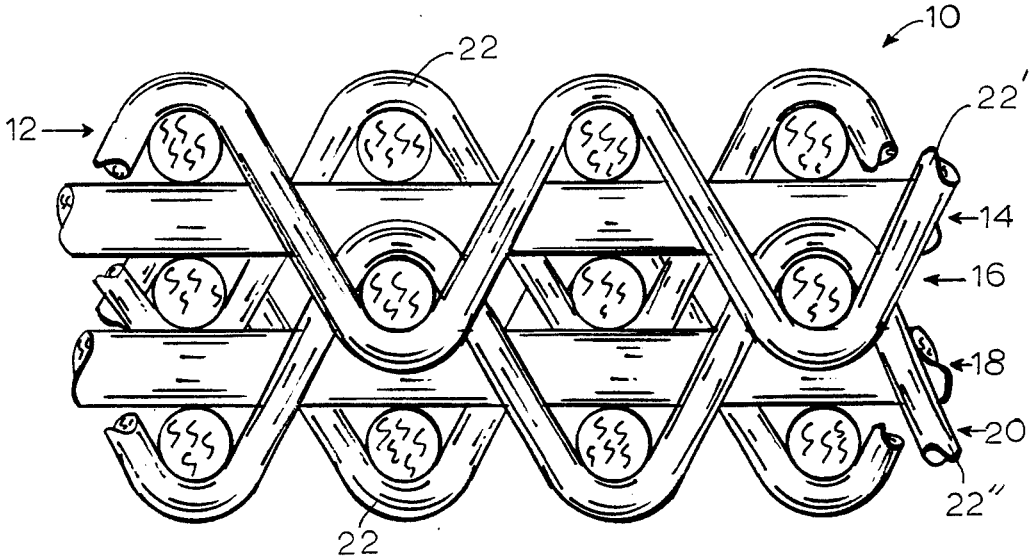
FIG. 3 is a second cross-sectional view of FIG. 1.

Reference is now made to the FIGS. 1–3 in which an endless press felt 10 is shown comprising five layers in generally parallel planes with each layer comprising a plurality of parallel yarns. The layers are identified in the Figures respectively by numerals 12, 14, 16, 18 and 20. The yarns of the first, third and fifth layer (i.e. layers 12, 16 and 20) are oriented in the machine direction while the yarns of the second and fourth layers (i.e. layers 14 and 18) are oriented in the cross-machine direction.

The layers are not interwoven. One or more relatively thin threads 22 are used to bind the layers vertically together. For example two threads, 22' and 22'' may be used to bind the yarns of the center or middle layer to the top and bottom layers respectively as shown in FIG. 3. This type of construction insures that the individual yarns of the layers do not shift laterally. Preferably threads 22' and 22'' alternate from one row to another as shown in FIG. 2, each row extending in a cross-machine direction.

Figure 4:
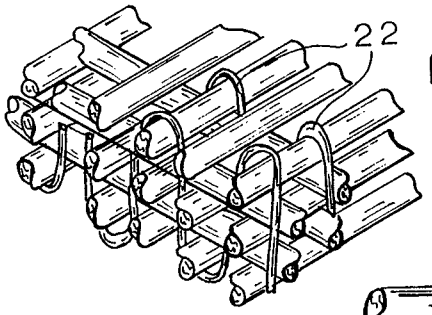
FIG. 4 shows an alternate embodiment of the invention.

Alternately, a single thread 22 may be used to bind the layers vertically as shown in FIG. 4. Thread 22 is passed perpendicularly through each layer. Threads 22 are disposed in the cross-machine direction.

It has been found that the above-disclosed press felt has a number of desirable physical characteristics. For example, each layer provides a support platform which supports the other layers while the felt is passed through a press nip. As a result, the felt is able to withstand numerous, repetitive compression cycles before the caliper deteriorates to a point where it can no longer handle water. In other words, the felt exhibits relatively large compaction resistance, and at the same time the physical construction of the felt insures its dimensional stability. Both of these characteristics are enhanced by the binding thread which provides a vertical support member. Furthermore, it is well known that "knuckles" formed when one yarn changes levels or is partially wrapped around another yarn in woven fabrics are weakness points which wear away relatively rapidly. Since the present fabric lacks "knuckles" its useful life is much longer.

The yarns forming the individual layers are spaced to form an open fabric. The interstices formed between these yarns enable the felt to absorb and carry relatively large amounts of water from a paper web.

In addition the unique felt structure presented herein can be manufactured on well-known looms.

Preferably the yarns are plied monofilament or plied multifilament nylon yarns and the thread is a multifilament nylon thread. In order to increase the resilence and compaction resistance of the felt, over the middle layer, such as, for example, the yarns 16 of the third layer 16 could be made of a softer, more resilient material such as polyurethane monofilament. This layer acts as a shock absorber to dampen the effects of sudden compressive forces on the felt.

While in the above description a felt was defined as having five layers, a greater or lesser number of layers are also possible. Other modifications would be obvious to one skilled in the art without departing from the scope of the invention as defined in the appended claims.

I claim:

1. A press felt comprising:

a plurality of layers of yarns, the yarns of each layer oriented in parallel with respect to each other and perpendicular with respect to the yarns of adjacent layers, the yarns of one layer not binding the yarns of adjacent layers; and separate binder means for binding said layers.

2. The press felt of claim 1 wherein the yarns of alternate layers extend in the machine direction.

3. The press felt of claim 1 wherein the binder means comprises threads which are passed perpendicularly between the layers.

4. The press felt of claim 3 wherein the threads extend in the cross-machine direction.

5. The press felt of claim 4 wherein the yarns of the layers are engaged by alternate threads.

6. The press felt of claim 1 wherein one layer is made of relatively resilient yarn to form a shock absorbing layer.

7. The press felt of claim 6 wherein said shock absorbing layer is a middle layer.

8. The press felt of claim 1 wherein the yarns are spaced to form an open fabric.

9. The press felt of claim 1 wherein one of said layers is a top layer and said binder means binds said top layer to other layers without any substantial knuckles.

10. The press felt of claim 9 wherein said binder means comprises a thread thinner than the yarns of said top layer.

11. A press felt for dewatering a moist paper web comprising:

first, second, third, fourth and fifth layers, each layer comprising a plurality of unwoven, parallel, coplanar yarns, the yarns of said first, third and fifth layer extending in a first direction and the yarns of said second and fourth layer extending in a second direction perpendicular to said first direction the yarns of one layer being unbound by the yarns of any adjacent layers; and binder means for binding said layers.

12. The press felt of claim 11 further having a machine direction and a cross-machine direction wherein said first direction is the machine direction and said second direction is the cross-machine direction.

13. The press felt of claim 12 wherein said binder means comprises threads which are passed perpendicularly through said layers.

14. The press felt of claim 13 wherein said threads extend in the cross-machine direction.

15. The press felt of claim 13 wherein said first, second and third layers are bound by a first set of threads and said third fourth and fifth layers are bound by a second set of threads.

16. The press felt of claim 11 wherein one of said layers is made of a resilient yarn to form a shock absorbing layer.

17. The press felt of claim 16 wherein said shock absorbing layer is said third layer.

18. The press felt of claim 11 wherein said binder means binds said first layer to other layers without any substantial knuckles.

19. The press felt of claim 18 wherein said binder means comprises a thread thinner than the yarns of said first layer.

* * * * *